US005279197A

United States Patent [19]

Takeda et al.

[11] Patent Number: 5,279,197

[45] Date of Patent: Jan. 18, 1994

[54] PUNCHING PRESS

[75] Inventors: Shinya Takeda, Kawasaki; Kazuo Saegusa, Fukushima, both of Japan

[73] Assignee: Mechtro Joban International Co., Ltd., Tokyo, Japan

[21] Appl. No.: 978,279

[22] Filed: Nov. 18, 1992

[30] Foreign Application Priority Data

Dec. 16, 1991 [JP] Japan ..... 3-352675

[51] Int. Cl.[5] ..... B26F 01/04

[52] U.S. Cl. ..... 83/631; 83/617; 83/549

[58] Field of Search ..... 83/617, 631, 632, 684, 83/687, 688, 552, 549, 530, 686

[56] References Cited

U.S. PATENT DOCUMENTS

| | | | |
|---|---|---|---|
| 2,582,094 | 1/1952 | Balsam et al. | 83/631 |
| 3,677,117 | 7/1972 | Cutter | 83/688 |
| 3,783,728 | 1/1974 | Glasman et al. | 83/631 |
| 4,220,062 | 9/1980 | Blanz | 83/549 |
| 4,907,480 | 3/1990 | Kuroyone | 83/552 |
| 4,987,811 | 1/1991 | Ikarashi et al. | 83/687 |
| 5,163,350 | 11/1992 | Groswith, III et al. | 83/549 |

*Primary Examiner*—Richard K. Seidel
*Assistant Examiner*—Allan M. Schrock
*Attorney, Agent, or Firm*—Rogers & Killeen

[57] ABSTRACT

A punching press according to the present invention employs a servo motor as the driving source of the punching operation to achieve fine control, and exhibits a performance which is equivalent to or higher than that of a conventional punching press which employs a hydraulic cylinder. A hammer member which performs the punching operation is coupled to a stroke member which performs a stroke motion. The stroke member is coupled to a motion converting unit which converts the rotational motion of a servo motor into a stroke motion.

5 Claims, 5 Drawing Sheets

FIG. 3
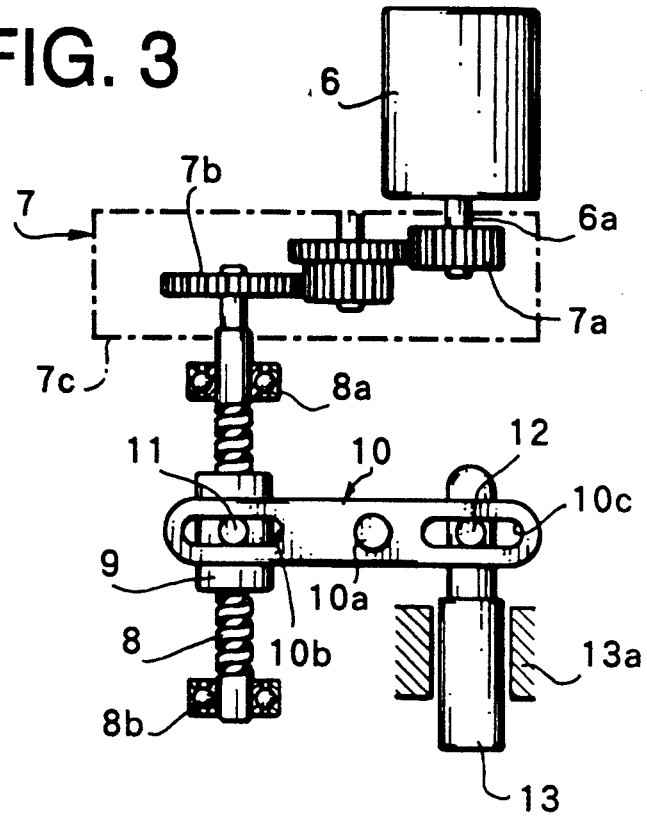
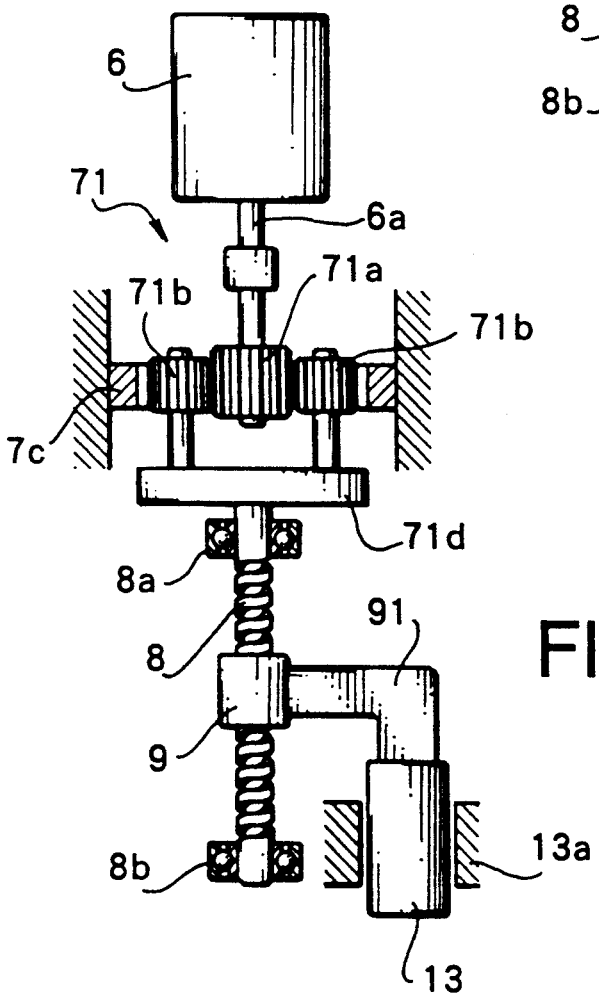
FIG. 4

PUNCHING PRESS

BACKGROUND OF THE INVENTION

1. Field of the Invention

The present invention relates to a punching press which employs a servo motor as the drive source for the punching operation.

2. Description of the Related Art

In punching presses, a so-called mechanical crank type driving source is generally used as the driving source for the punching operation. Since the punching operation is the repetition of the short stroke motions, it is considered that the use of a mechanical crank and a flywheel as the driving source for generating the stroke motions is advantageous in terms of the simplification of the mechanism and structure.

In the punching presses which are available in recent years, attempts have been made to finely control the press stroke motions in order to achieve reduction in the punching noises and a punching operation which is suitable to the thickness or material of a blank. However, the control of the press stroke cannot be performed in the mechanical crank type punching press, and hence a mechanism which employs a hydraulic cylinder as the driving source for the punching operation has been proposed. However, the desired punching operation achieved by the use of the hydraulic cylinder requires a large hydraulic power unit. Such a large hydraulic power unit may cause problems involving the operation noises or heat, and hence requires an auxiliary facility, such as a cooling means or noise cover, thus requiring an large installation space for the auxiliary facility. Also, the hydraulic control system has a complicated structure, and it is thus difficult to achieve the control operation which has excellent responsibility.

SUMMARY OF THE INVENTION

In view of the aforementioned problems of the conventional techniques, an object of the present invention is to provide a punching press which employs, as the driving source for the punching operation, a servo motor to achieve fine control and which exhibits the operation performance which is equivalent to or higher than that of the punching press which employs a hydraulic cylinder.

To achieve the above object, the present invention provides a punching press which comprises a hammer member which performs a punching operation, a stroke member which performs a stroke motion, the stroke member being connected to the hammer member, a servo motor, and a motion converting unit for converting a rotational motion of the servo motor into a stroke motion, the motion converting unit being connected to the stroke member.

BRIEF DESCRIPTION OF THE DRAWINGS

FIGS. 3 through 6 are side views schematically showing hammer member driving mechanisms in the punching press according to the present invention.

DETAILED DESCRIPTION OF THE PREFERRED EMBODIMENTS

An embodiment of a punching press according to the present invention will be described below with reference to the accompanying drawings.

Figure 1:
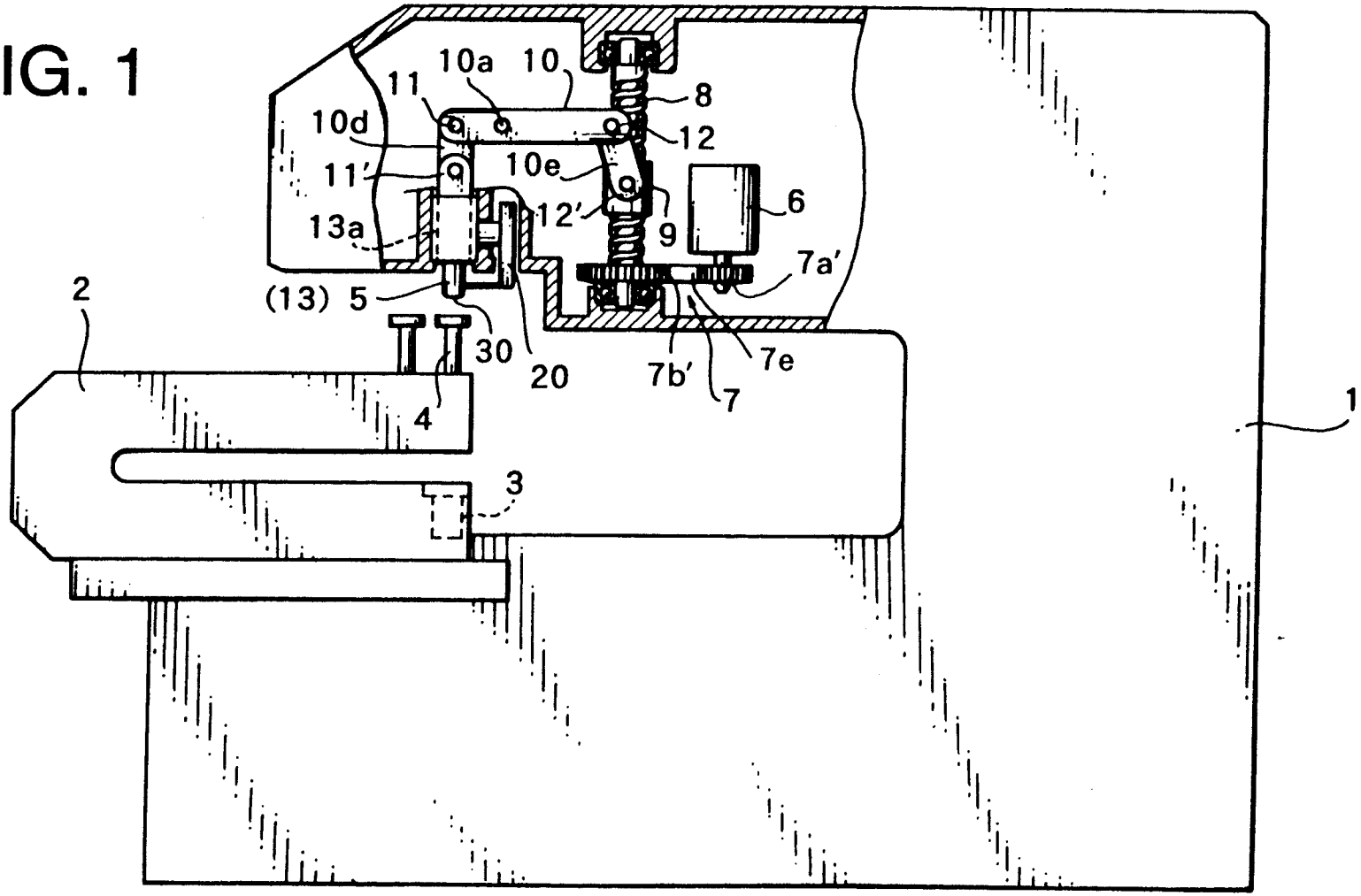
FIG. 1 is a side view of a punching press schematically showing an embodiment of the present invention.

Referring first to FIG. 1, reference numeral 1 denotes a frame of a punching press; 2 denotes a plate on which a die set is mounted; 3 denotes a die set; 4 denotes a punching set provided on the plate 2 immediately above the die set 3; 5 denotes a hammer member provided on the frame 1 immediately above the punching set 4 to make the punching set stroke motion. When a plurality of punching sets 4 and a plurality of die sets 3 are provided on the die set mounting plate 2 parallel to each other, the hammer member 5 may be made movable in the X and Y axes directions so that it can be positioned immediately above each pair of punching set 4 and die set 3. Alternatively, the die set mounting plate 2 may be made movable in the X and Y axes directions so that the hammer member 5 can be positioned immediately above each pair of punching set 4 and die set 3. Although not shown in FIG. 1, a table and a work hand are provided at the open portion of the frame 1.

In the conventional punching press, the stroke motion of the hammer member 5 is produced by means of a mechanical crank mechanism or a hydraulic cylinder. In the present invention, the stroke motion of the hammer member 5 is produced by means of an output of a servo motor through any of the mechanisms shown in FIGS. 3 through 6. Such a hammer member stroke motioning mechanism will be described below.

In FIG. 3, reference numeral 6 denotes a servo motor; 6*a* denotes an output shaft of the servo motor 6; 7 denotes a reduction gear which has a gear train including a pinion 7*a* provided on the output shaft 6*a* and a gear 7*b* which meshes with the pinion 6*a* through a gear; and 7*c* denotes a gear box. The concrete structure of the gear train is not limited to that shown in FIG. 3. Furthermore, the reduction gear 7 is not limited to that which employs a gear train but a reduction gear 7', such as that shown in FIG. 1, including sprockets 7*a*' and 7*b*', a chain 7*e*, a toothed belt, and a grooved pulley, may also be used.

An output shaft 7*d* of the reduction gear 7 shown in FIG. 3 is coupled to a feed screw 8 through an adequate joint, such as a coupling. The feed screw 8 is supported by bearings 8*a* and 8*b*. A nut member 9 is engaged with the feed screw 8.

In the mechanism shown in FIG. 3, the intermediate portion of the nut member 9 is pin-coupled 11 to an elongated hole 10*b* formed at the rear end of a lever member 10 supported at a fixed support 10*a*, and an elongated hole 10*c* formed at the front end of the lever member 10 is pin-coupled 12 to a hammer member 13. In this way, upward and downward stroke motions of the nut member 9 are transmitted to the hammer member 13 through the lever member 10.

At least the two sides or the entire periphery of the hammer member 13 are slidably retained by a slide guide 13*a* so that it can perform the punching operation on the punching set 4 from immediately above it, as in the case of the conventional machine. In the punching press shown in FIG. 1, the pin-couplings of the lever member 10 do not employ the elongated holes 10*b* and 10*c* provided in the mechanism shown in FIG. 3, but employ connection links 10*d* and 10*e* which are inserted between the hammer member 13, the nut member 9 and the lever member 10. The two ends of each of the links 10*d* and 10*e* are pin-coupled 11, 11' or 12, 12' to the lever member 10 and the hammer member 13 or the nut member 9.

FIG. 4 shows a punching press which employs a reduction gear mechanism 71 which includes a sun gear and planetary gears. In FIG. 4, reference numeral 71*a* denotes a sun gear; 71*b* denotes planetary gears; and 71*c* denotes a fixed internally toothed gear. Since a mounting plate 71*d* on which the planetary gears 71*b* are mounted acts as the output end of the mechanism 71, the feed screw 8 is coupled to the center of rotation of this plate 71*d*.

In the mechanism shown in FIG. 4, the nut member 9 is engaged with the feed screw 8. An arm member 91 extends from the nut member 9 horizontally, and the hammer member 13 is directly coupled to the lower end of the arm member 91. Thus, in the mechanism shown in FIG. 4, the punching operation of the hammer member 13 is produced by means of the nut member 9 which stroke motions up and down by the rotation of the servo motor 5 in two directions.

Figure 5:
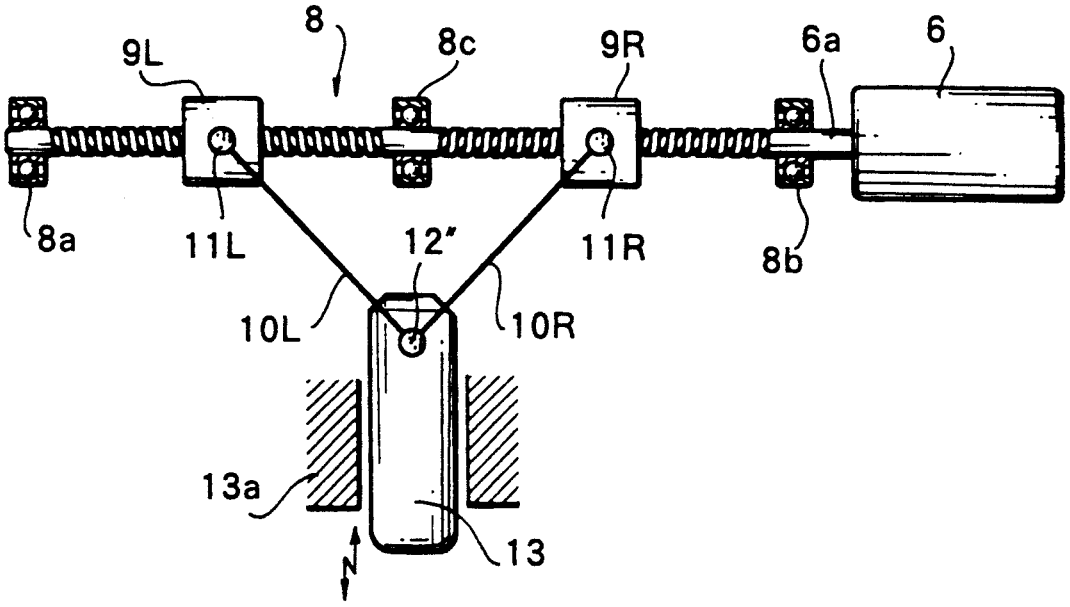

FIG. 5 shows a punching mechanism in which a feed screw 81 whose right and left portions are screwed in two different directions is disposed horizontally. One end of the screw 81 is coupled to the output shaft 6*a* of the servo motor 6. Nut members 9L and 9R are respectively engaged with the left and right sides of the screw 81. Upper ends of connection links 10L and 10R are respectively pivot-coupled 11L and 11R to the nut members 9L and 9R, while lower ends of the links 10L and 10R are coupled to the hammer member 13 through a common pivot shaft 12".

In the mechanism shown in FIG. 5, the nut members 9L and 9R move on the screw 81 symmetrically with respect to the center of the screw 81 by the rotation of the motor 6 in two directions. The punching operation of the hammer member 13 is produced by the operation of the links 10L and 10R which follow the motion of the nut members 9L and 9R.

Figure 2:
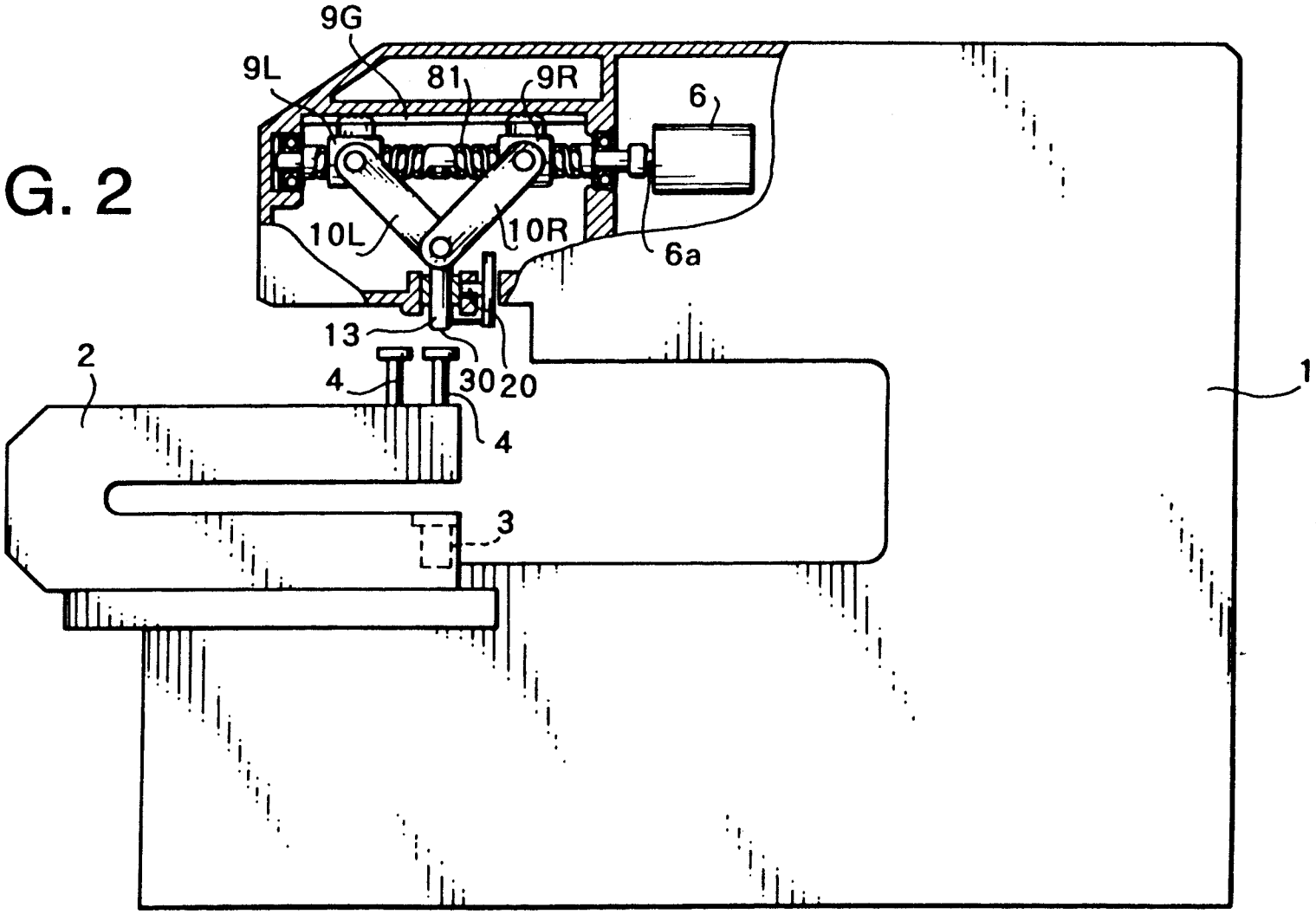
FIG. 2 is a side view of the punching press showing another embodiment of the present invention.

FIG. 2 shows an example of the punching press which employs the mechanism shown in FIG. 5. Identical reference numerals in FIG. 2 to those in FIGS. 1 and 5 represent similar or identical elements. Reference numeral 9G denotes a slide guide which also serves to prevent turning of the nut members.

Figure 6:
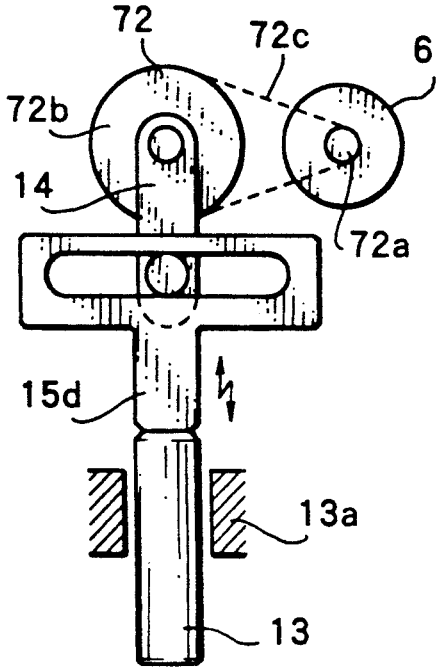

FIG. 6 shows a punching mechanism in which a slider member 15*d*, which is a reciprocative slider link, is coupled to a crank member 14 to which the output of the motor 6 is transmitted at a reduced speed, and in which the hammer member 13 is provided at the lower end of the slider member 15*d*. In this mechanism, the hammer member 13 slides up and down by the rotation of the servo motor 6 in one direction and thereby performs the punching operation.

In the punching press according to the present invention, since the servo motor 6 is employed as the driving source for the punching operation of the hammer member 13, the punching operation of the hammer member 13 can be controlled at a control level of the servo motor 6 which can be easily controlled finely and highly responsively.

Figure 7:
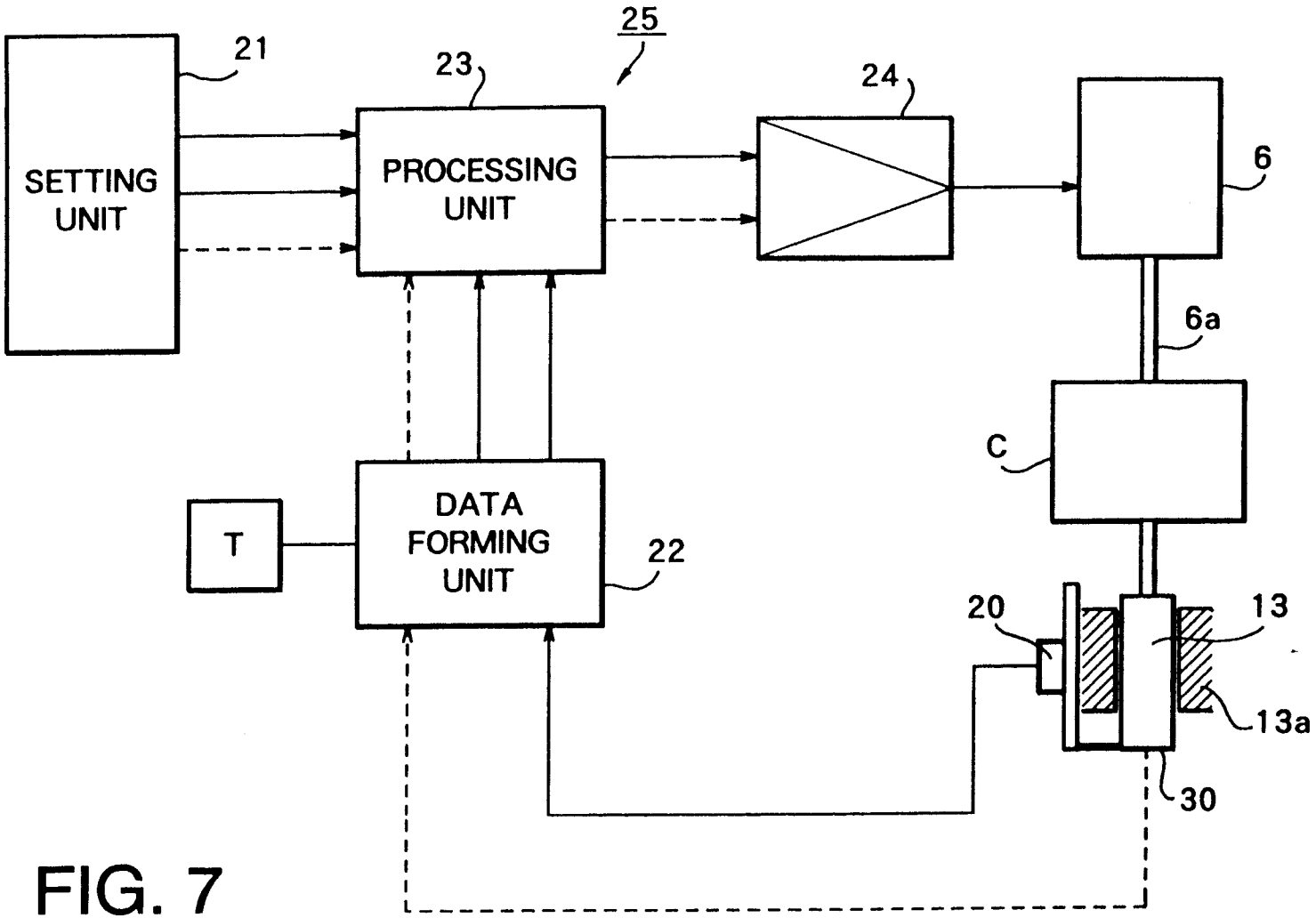
FIG. 7 is a block diagram illustrating an example of a control system in the punching press according to the present invention.

For example, in the punching operation, i.e., in the reciprocative stroke motion, of the hammer member 13, it is possible to operate the hammer member 13 at a desired speed at a desired stroke position, as shown in FIG. 7.

The control system shown in FIG. 7 includes a position detector 20 for detecting the stroke position of the hammer member 13, and a control unit 25. The control unit 25 includes a setting unit 21 for setting the position of the hammer member 13 as well as the speed, pressure and so on of the hammer member 13 located at that position, a present data forming unit 22 for taking in the data of the detector 20 and for forming the present data, such as the position, speed or pressure, of the hammer member 13, a processing unit 23 for comparing the present data with the set data, and a motor drive control unit 24 for controlling the drive of the servo motor 6 on the basis of the output of the processing unit 23. In FIG. 7, reference numeral T denotes a timer for reference clock; and C denotes a motion converting mechanism which may be the aforementioned reduction gear mechanism or the link mechanism.

In the control unit 25, the setting unit 21 and the present data forming unit 22 may also be arranged such that they set and form the acceleration data of the stroke motion of the hammer member 13.

Furthermore, the aforementioned control system may also be arranged such that a pressure detector 30 is provided on the hammer member 13 (or on the die) to detect the punching pressure during the punching operation, that the punching pressure which can be determined freely depending on the punching conditions, such as the thickness of the material to be punched or the material thereof, is set in the setting unit 21, and that the servo motor 6 is driven on the basis of the results of the comparison conducted between the set punching pressure and the actually detected punching pressure.

In the control system shown in FIG. 7, since the operation of the hammer member 13 can be controlled using the position, speed and acceleration thereof as well as the punching pressure or using the punching pressure alone, the punching operation can be controlled more finely.

As will be understood from the foregoing description, since the punching press employs, as the driving source thereof, a servo motor which exhibits a fine and excellent responsibility, a control operation, which would not be achieved by the conventional machine, can be relatively easily obtained.

Particularly, since the punching mechanism according to the present invention employs, in place of the hydraulic cylinder employed in the conventional machine, a servo motor and a mechanism for converting the rotational motion of this motor into a linear motion, the punching operation can be controlled at a servo control level of the servo motor. Furthermore, since the hydraulic power unit, the cooling unit therefor and noise cover, which would be required for the hydraulic cylinder, are unnecessary, the installation space for the press can be reduced. The present invention is particularly advantageous when it is applied to a small punching press.

What is claimed is:

1. A punching press comprising:

a frame for holding a workpiece;

hammer means slidably mounted in said frame for punching a hole in the workpiece, and having a first pin affixed thereto;

a feed screw rotatably mounted in said frame;

an electric servo motor for imparting rotational motion to said feed screw;

a first nut rotatably carried by said feed screw and having a second pin affixed thereto;

a second nut rotatably carried by said feed screw and having a third pin affixed thereto; and two links, a first having a first end affixed to said first pin and a second end affixed to said second pin, and the second link having a first end connected to said first pin and a second end affixed to said third pin, whereby operation of said electric servo motor rotates said feed screw, causing said first and second nuts to move relative to each other, thereby causing said manner to perform a punching operation on the workpiece.

2. The punching pres of claim 1 further comprising a reduction gear connecting said electric servo motor to said feed screw.

3. The punching press of claim 2 wherein said reduction gear comprises a gear train.

4. The punching press of claim 2 wherein said reduction gear comprises a toothed belt and a grooved pulley.

5. The punching press of claim 2 wherein said reduction gear comprises plural sprockets and a chain.

* * * * *